US006907804B2

(12) United States Patent
Shu-Ying et al.

(10) Patent No.: US 6,907,804 B2
(45) Date of Patent: Jun. 21, 2005

(54) PAWL SWITCH MEMBER FOR RATCHET TOOLS

(76) Inventors: Tseng Shu-Ying, 11F-2, No. 43, Chai-I Street, Taichung City (TW); Hua-Rung Yu, 4F, No. 357, Ta-Na Road, Su-Lin, Taipei City (TW)

( * ) Notice: Subject to any disclaimer, the term of this patent is extended or adjusted under 35 U.S.C. 154(b) by 117 days.

(21) Appl. No.: 10/637,928

(22) Filed: Aug. 7, 2003

(65) Prior Publication Data

US 2004/0025645 A1 Feb. 12, 2004

Related U.S. Application Data

(63) Continuation-in-part of application No. 10/104,529, filed on Mar. 25, 2002, now abandoned.

(51) Int. Cl.[7] ..... B25B 13/46
(52) U.S. Cl. ..... 81/63.2; 81/63.1
(58) Field of Search ..... 81/63.2, 63, 63.1, 81/61

(56) References Cited

U.S. PATENT DOCUMENTS 5,957,009 A * 9/1999 McCann ..... 81/63.2
6,260,449 B1 * 7/2001 I-He ..... 81/63.2
6,435,063 B1 * 8/2002 Chen ..... 81/63.2
6,513,409 B1 * 2/2003 Lee ..... 81/63
6,629,477 B2 * 10/2003 Ling et al. ..... 81/63.2
2003/0177872 A1 * 9/2003 Shu-Ying et al. ..... 81/63.2

* cited by examiner

*Primary Examiner*—Lee D. Wilson
(74) *Attorney, Agent, or Firm*—Charles E. Baxley

(57) ABSTRACT

A ratchet tool includes a head with a toothed driving member and a pawl respectively received therein. The pawl has a protrusion which is engaged with a recessed area defined in an underside of a pawl shifting member on one of two sides of the head of the tool, so that the pawl is urged to engage with the toothed driving member by shifting a lever on the pawl shifting member. A spring and a bead are received in a hole defined in a top of the pawl shifting member. A cap is engaged with the head so as to position the driving member and includes an extension which is covered on the pawl shifting member and has two positioning recesses. The bead is engaged with one of the two positioning recesses.

3 Claims, 2 Drawing Sheets

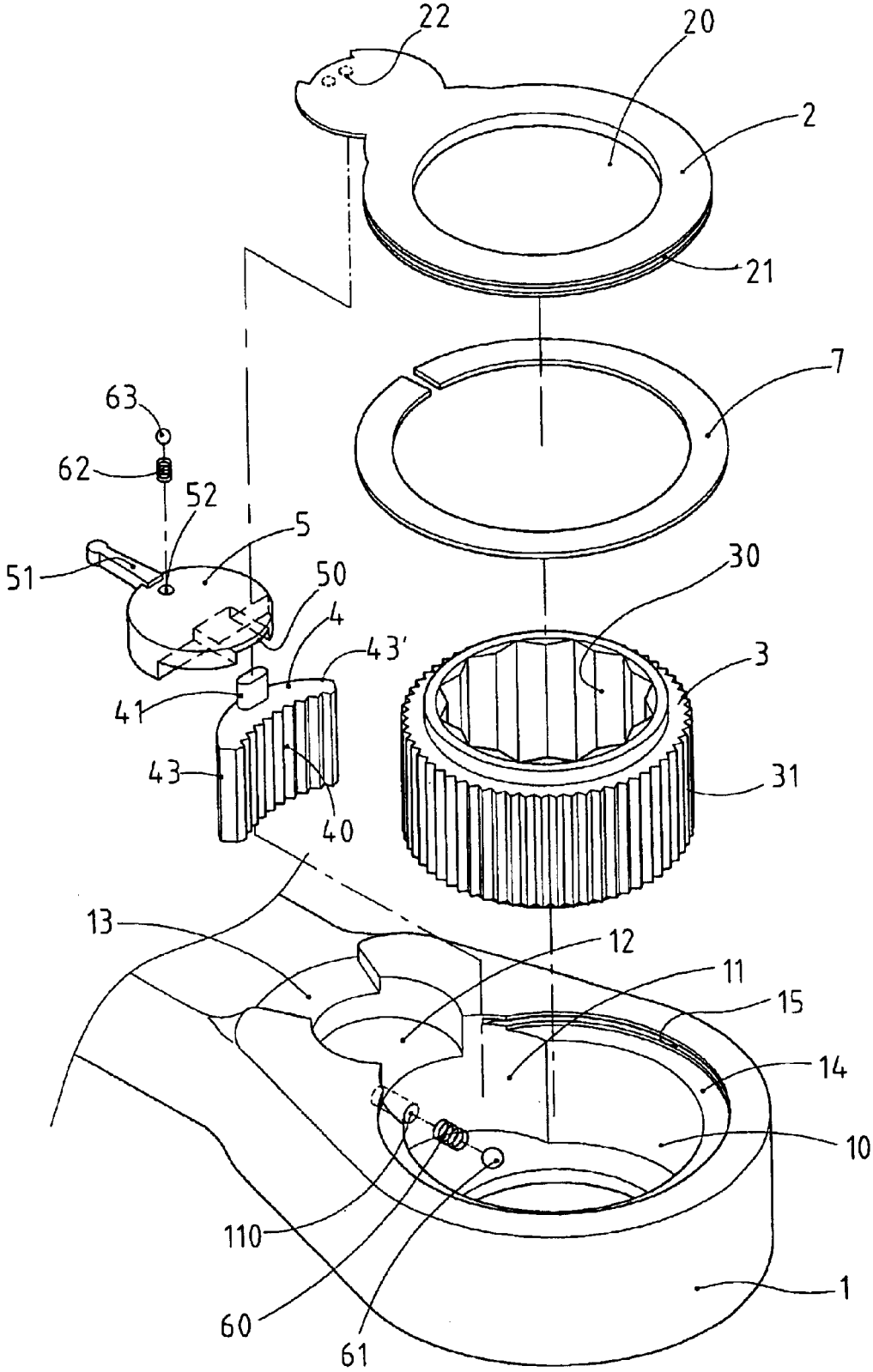
FIG. ONE

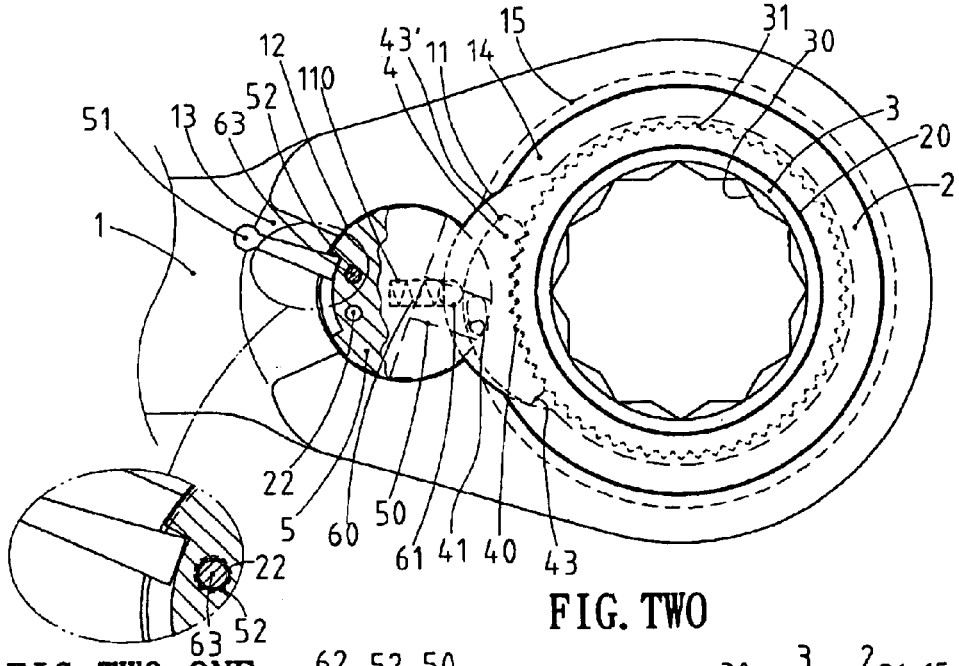
FIG. TWO
FIG. TWO-ONE
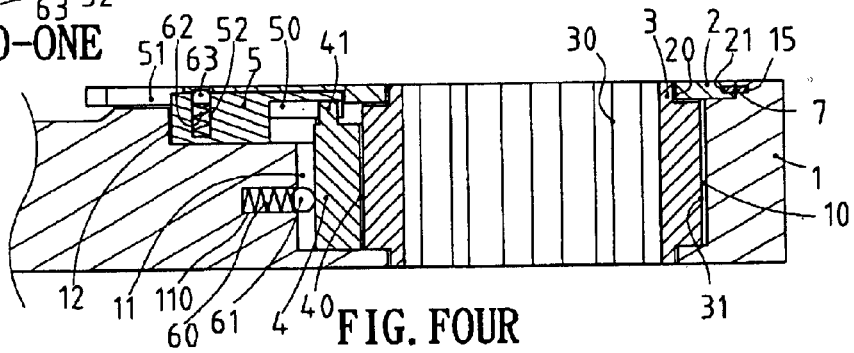
FIG. FOUR
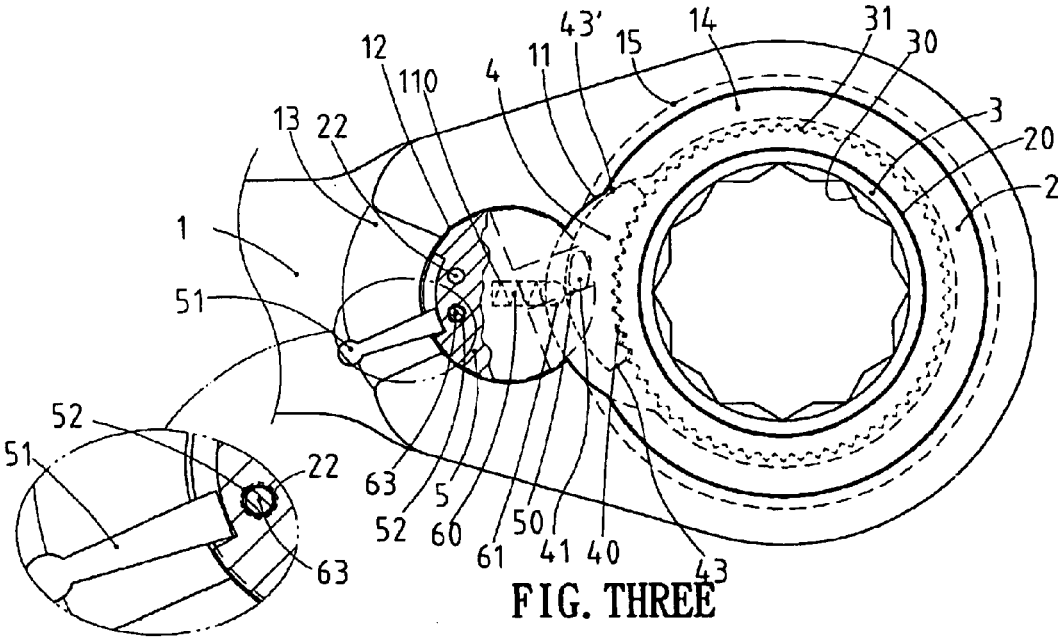
FIG. THREE
FIG. THREE-ONE

PAWL SWITCH MEMBER FOR RATCHET TOOLS

This is a Continuation-In-Part application of applicant's former patent application with the application Ser. No. 10/104,529, filed on Mar. 25, 2002 now abandoned.

BACKGROUND OF THE INVENTION

Field of the Invention

A conventional ratchet tool generally includes a head with a ratchet mechanism received therein and a handle connected to the head. The ratchet mechanism includes a toothed engaging member and a pawl is engaged with the teeth of the toothed engaging member. The pawl is controlled by a pawl shifting member which generally extends from the top surface of the head and the pawl shifting member limits the head of the tool from inserting into a recess to reach a bolt or an object to be tightened or loosened.

Besides, the pawl shifting member is applied a force that comes from the pawl when the teeth of the pawl move over the teeth of the toothed engaging member during rotating the handle of the tool. The force slightly moves the pawl shifting member away from the head of the tool and the movement gives a quality of assembly issue to the users. In other words, the pawl shifting member is not well positioned during the rotating the handle while the engaging member is stationary relative to the head of the tool.

SUMMARY OF THE INVENTION

In accordance with one aspect of the present invention, there is provided a ratchet tool which comprises a handle and a head which has a through hole for receiving a driving member therein and a recess is defined in an inner periphery of the through hole. A first hole is defined in an inner periphery of the recess for receiving a first spring and a first bead therein. A first concavity is defined in one of two sides of the head and communicates with the recess so as to receive a pawl shifting member therein. A second concavity is defined in a throat portion connected between the handle and the head so as to receive a pawl shifting member therein. The pawl has a protrusion extending from an end surface thereof and the pawl shifting member has recessed area defined in an underside thereof so as to accommodate the protrusion of the pawl. A lever extends from the pawl shifting member and is movably engaged with the second concavity. A second hole is defined in a top of the pawl shifting member and a second spring and a second bead are received in the second hole.

A cap is engaged with a groove defined in the inner periphery of the through hole in the head and has a hole so that an end of the driving member is engaged with the hole in the cap. An extension extends outward from the cap and includes two positioning recesses so that the second bead is engaged in one of the two positioning recesses.

The primary object of the present invention is to provide a ratchet tool wherein the pawl switch member is well positioned during operation and is not moved by the pawl during rotation of the handle.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the ratchet tool of the present invention;

FIG. 2 is a top view to show the arrangement of the driving member, the pawl and the pawl switch member of the ratchet tool of the present invention;

FIG. 2-1 shows an enlarged view of the second bead being engaged with one of the two positioning recesses in the cap;

FIG. 3 shows the second bead is shifted to the other one of the two positioning recesses in the cap;

FIG. 3-1 shows an enlarged view of the second bead being engaged with the other one of the two positioning recesses in the cap, and FIG. 4 is a side cross sectional view to show the ratchet tool of the present invention.

DETAILED DESCRIPTION OF THE PREFERRED EMBODIMENTS

Referring to FIGS. 1, 2-1, and 4, the ratchet tool of the present invention comprises a handle and a head 1 which has a through hole 10 defined therethrough so that a driving member 3 is engaged with the through hole 10, and a recess 11 is defined in an inner periphery of the through hole 10 so that a pawl 4 is movably received in the recess 11. The driving member 3 has first teeth 31 defined in an outer periphery thereof and has a polygonal inner periphery 30 such that a nut for example can be clamped by the polygonal inner periphery 30.

A first hole 110 is defined in an inner periphery of the recess 11 and a first spring 60 and a first bead 61 are received in the first hole 110. The pawl 4 has second teeth 40 defined in a first side thereof so as to be engaged with the first teeth 31 of the driving member 3. The first bead 61 contacts a second side of the pawl 4. An elongate protrusion 41 extends from an end surface of the pawl 4.

A first concavity 12 is defined in one of two sides of the head 1 and communicates with the recess 11, and a second concavity 13 is defined in a throat portion connected between the handle and the head 1. The second concavity 13 communicates with the first concavity 12. The first concavity 12 and the second concavity 13 are located in two different horizontal planes.

A pawl shifting member 5 is rotatably received in the first concavity 12 and has a recessed area 50 defined in an underside thereof so as to accommodate the protrusion 41 of the pawl 4. A lever 51 extends from the pawl shifting member 5 and is movably engaged with the second concavity 13. A second hole 52 is defined in a top of the pawl shifting member 5 and a second spring 62 and a second bead 63 are received in the second hole 52.

There is a shoulder portion 14 extends from the inner periphery of the through hole 10 in the head 1 and a retaining member 7 is rested on the shoulder portion 14 and encloses an annular flange extending from an end of the driving member 3. The retaining member 7 is engaged with the a groove 15 defined in the inner periphery of the through hole 10 in the head 1. A cap 2 has a hole 20 defined therethrough so that the annular flange of the driving member 3 is engaged with the hole 20 in the cap 2. A groove 21 is defined in an outer periphery of the cap 2 so that an inner periphery of the retaining member 7 is engaged with the groove 21 to position the cap 2. An extension extends outward from the cap 2 and covers on the pawl shifting member 5. Two positioning recesses 22 are defined in an underside of the extension of the cap 2 so that the second bead 63 is engaged in one of the two positioning recesses 22.

It is to be noted that the top of the pawl shifting member 5 is a flat surface which is in flush with the side of the head 1 so that no extra protrusion protrudes from the side of the head 1 and this allows the head 1 of the ratchet tool to be inserted in a narrow space.

When the second bead 63 is engaged with one of the two positioning recesses 22 as shown in FIG. 2-1, this position means that the lever 51 is pushed upward in the drawing and the remote end 43 contacts the inner periphery of the recess 11. When rotating the handle counter clockwise, the driving member 3 is co-rotated with the handle, and the nut (not shown) clamped by the driving member 3 is loosened or tightened.

As shown in FIGS. 3 and 3-1, when shifting the lever 51 downward in the drawing, the second bead 63 is moved to the other positioning recess 22. When rotating the handle counter clockwise, the second teeth 40 of the pawl 4 move over the first teeth 31 of the driving member 3 while the driving member 3 is remained still. The pawl shifting member 5 is well positioning by the engagement of the second bead 63 and the positioning recesses 22 so that the pawl shifting member 5 will not move during operation by the pawl 4.

While we have shown and described the embodiment in accordance with the present invention, it should be clear to those skilled in the art that further embodiments may be made without departing from the scope of the present invention.

What is claimed is:

1. A ratchet tool comprising:

a handle and a head which has a through hole defined therethrough and a recess defined in an inner periphery of the through hole, a first hole defined in an inner periphery of the recess and a first spring and a first bead are received in the first hole, a first concavity defined in one of two sides of the head and communicating with the recess, a second concavity defined in a throat portion connected between the handle and the head, the second concavity communicating with the first concavity;

a driving member rotatably received in the through hole and having first teeth defined in an outer periphery thereof, a polygonal inner periphery defined in the driving member;

a pawl movably received in the recess and having second teeth defined in a first side thereof so as to be engaged with the first teeth of the driving member, the first bead contacting a second side of the pawl, a protrusion extending from an end surface thereof;

a pawl shifting member rotatably received in the first concavity and having a recessed area defined in an underside thereof so as to accommodate the protrusion of the pawl, a lever extending from the pawl shifting member and movably engaged with the second concavity, a second hole defined in a top of the pawl shifting member and a second spring and a second bead received in the second hole, and a cap engaged with a groove defined in the inner periphery of the through hole in the head and having a hole defined therethrough so that an end of the driving member is engaged with the hole in the cap, an extension extending outward from the cap and including two positioning recesses so that the second bead being engaged in one of the two positioning recesses.

2. The ratchet tool as claimed in claim 1, wherein the protrusion of the pawl is an elongate member.

3. The ratchet tool as claimed in claim 1, wherein the first concavity and the second concavity are located in two different horizontal planes.

* * * * *